US009430888B2

(12) United States Patent
Herrala

(10) Patent No.: US 9,430,888 B2
(45) Date of Patent: Aug. 30, 2016

(54) ACCESS CONTROL IN LOCATION TRACKING SYSTEM

(75) Inventor: Sami Herrala, Oulu (FI)

(73) Assignee: 9Solutions Oy, Oulu (FI)

( * ) Notice: Subject to any disclaimer, the term of this patent is extended or adjusted under 35 U.S.C. 154(b) by 53 days.

(21) Appl. No.: 13/330,133

(22) Filed: Dec. 19, 2011

(65) Prior Publication Data

US 2012/0154115 A1 Jun. 21, 2012

(30) Foreign Application Priority Data

Dec. 21, 2010 (EP) ..... 10196097

(51) Int. Cl.
*G08B 29/00* (2006.01)
*G07C 9/00* (2006.01)

(52) U.S. Cl.
CPC ..... *G07C 9/00111* (2013.01); *G07C 9/00103* (2013.01); *G07C 9/00658* (2013.01); *G07C 2009/0038* (2013.01); *G07C 2009/00333* (2013.01); *G07C 2009/00373* (2013.01); *G07C 2209/64* (2013.01)

(58) Field of Classification Search
CPC ..... G07C 2009/00373; G07C 2009/0038; G07C 2209/64
USPC ..... 340/5.64
See application file for complete search history.

(56) References Cited

U.S. PATENT DOCUMENTS

| | | | | |
|---|---|---|---|---|
| 6,150,948 | A * | 11/2000 | Watkins | 340/693.3 |
| 7,367,497 | B1 | 5/2008 | Hill | |
| 7,471,199 | B2 * | 12/2008 | Zimmerman et al. | 340/572.1 |
| 8,223,014 | B2 * | 7/2012 | Amir | 340/539.3 |
| 8,258,953 | B2 * | 9/2012 | Stern et al. | 340/572.1 |
| 2006/0015233 | A1 | 1/2006 | Olsen, III et al. | |

FOREIGN PATENT DOCUMENTS

| | | | |
|---|---|---|---|
| EP | 0 744 843 | A2 | 11/1996 |
| EP | 1 429 300 | A1 | 6/2004 |
| WO | WO 03/044743 | A2 | 5/2003 |
| WO | WO 2004/034336 | A1 | 4/2004 |
| WO | 2005031519 | A2 | 4/2005 |
| WO | 2006101615 | A1 | 9/2006 |

OTHER PUBLICATIONS

European Search Report for EP 10196097.9 dated May 10, 2011.
Communication dated Jan. 5, 2016, issued by the European Patent Office in corresponding European Application No. 10 196 097.9.
Communication dated Jun. 17, 2015 from the European Patent Office in counterpart European Application No. 10196097.9.

* cited by examiner

*Primary Examiner* — Vernal Brown
(74) *Attorney, Agent, or Firm* — Sughrue Mion, PLLC

(57) ABSTRACT

A method for controlling access in a location tracking system is provided. In response to detection of the presence of a mobile tag of the location tracking system in an area having at least one access control device, a location tracking device of the location tracking system activates the access control device to initiate establishment of a communication connection with the mobile tag so as to negotiate access rights of the mobile tag.

16 Claims, 6 Drawing Sheets

ACCESS CONTROL IN LOCATION TRACKING SYSTEM

FIELD

The invention relates to the technical field of location tracking systems.

BACKGROUND

Location tracking is used to monitor location and movement of objects, e.g. persons or equipment. Satellite based tracking systems, e.g. Global Positioning System (GPS), are probably the most common location tracking systems. However, their problem is that they are not suitable for indoor location tracking, because GPS signals do not penetrate building walls. For indoors location tracking, prior art teaches systems that utilize a pico network of wireless base stations, and the location of a given person in the coverage area of the pico network is determined on the basis of which wireless base station currently serves a personal communication device of the person. Prior art also teaches location tracking systems based on radio frequency identification (RFID) where a RFID readers are disposed to cover an area in which the location tracking is to be carried out. RFID tags are associated with monitored subjects, e.g. human beings and assets such as equipment. WiFi is also an option for carrying out location tracking.

BRIEF DESCRIPTION

The present invention provides a location tracking system that provides efficient access control.

According to an aspect, there is provided a method for controlling access in a location tracking system, the method comprising: tracking, by a location tracking apparatus, location of at least one mobile tag in a coverage area of the location tracking system; detecting presence of the mobile tag in a determined area comprising at least one access-controlled entity, wherein each access-controlled entity is associated with an access control apparatus; and in response to the detection of the mobile tag in the determined area, activating the access control apparatus to initiate establishment of a wireless communication connection with the mobile tag so as to negotiate about access to the access-controlled entity, wherein the activation is carried out by transmitting an activation signal from the location tracking apparatus to the access control apparatus.

According to another aspect, there is provided a location tracking system comprising a location tracking apparatus. The location tracking apparatus comprises at least one processor; and at least one memory including program instructions, wherein the at least one memory and the computer program code are configured, with the at least one processor, to cause the location tracking apparatus to: track location of at least one mobile tag in a coverage area of the location tracking system and to detect presence of the mobile tag in a determined area comprising at least one access-controlled entity, wherein each access-controlled entity is associated with an access control apparatus; and activate, in response to the detection of the mobile tag in the determined area, the access control apparatus to initiate establishment of a wireless communication connection with the mobile tag so as to negotiate about access to the access-controlled entity, wherein the activation is carried out by causing transmission an activation signal from the location tracking apparatus to the access control apparatus.

According to another aspect, there is provided a computer program product embodied on a non-transitory distribution medium readable by a computer and comprising program instructions which, when loaded into an apparatus, execute a computer process comprising: tracking location of at least one mobile tag in a coverage area of a location tracking system; detecting presence of the mobile tag in a determined area comprising at least one access-controlled entity, wherein each access-controlled entity is associated with an access control apparatus; and in response to the detection of the mobile tag in the determined area, activating the access control apparatus to initiate establishment of a wireless communication connection with the mobile tag so as to negotiate about access to the access-controlled entity, wherein the activation is carried out by causing transmission of an activation signal to the access control apparatus.

Embodiments of the invention are defined in the dependent claims.

LIST OF DRAWINGS

Embodiments of the present invention are described below, by way of example only, with reference to the accompanying drawings, in which FIG. 1 illustrates a location tracking system to which embodiments of the invention may be applied;

DESCRIPTION OF EMBODIMENTS

The following embodiments are exemplary. Although the specification may refer to "an", "one", or "some" embodiment(s) in several locations, this does not necessarily mean that each such reference is to the same embodiment(s), or that the feature only applies to a single embodiment. Single features of different embodiments may also be combined to provide other embodiments. Furthermore, words "comprising" and "including" should be understood as not limiting the described embodiments to consist of only those features that have been mentioned and such embodiments may contain also features/structures that have not been specifically mentioned.

Figure 1:
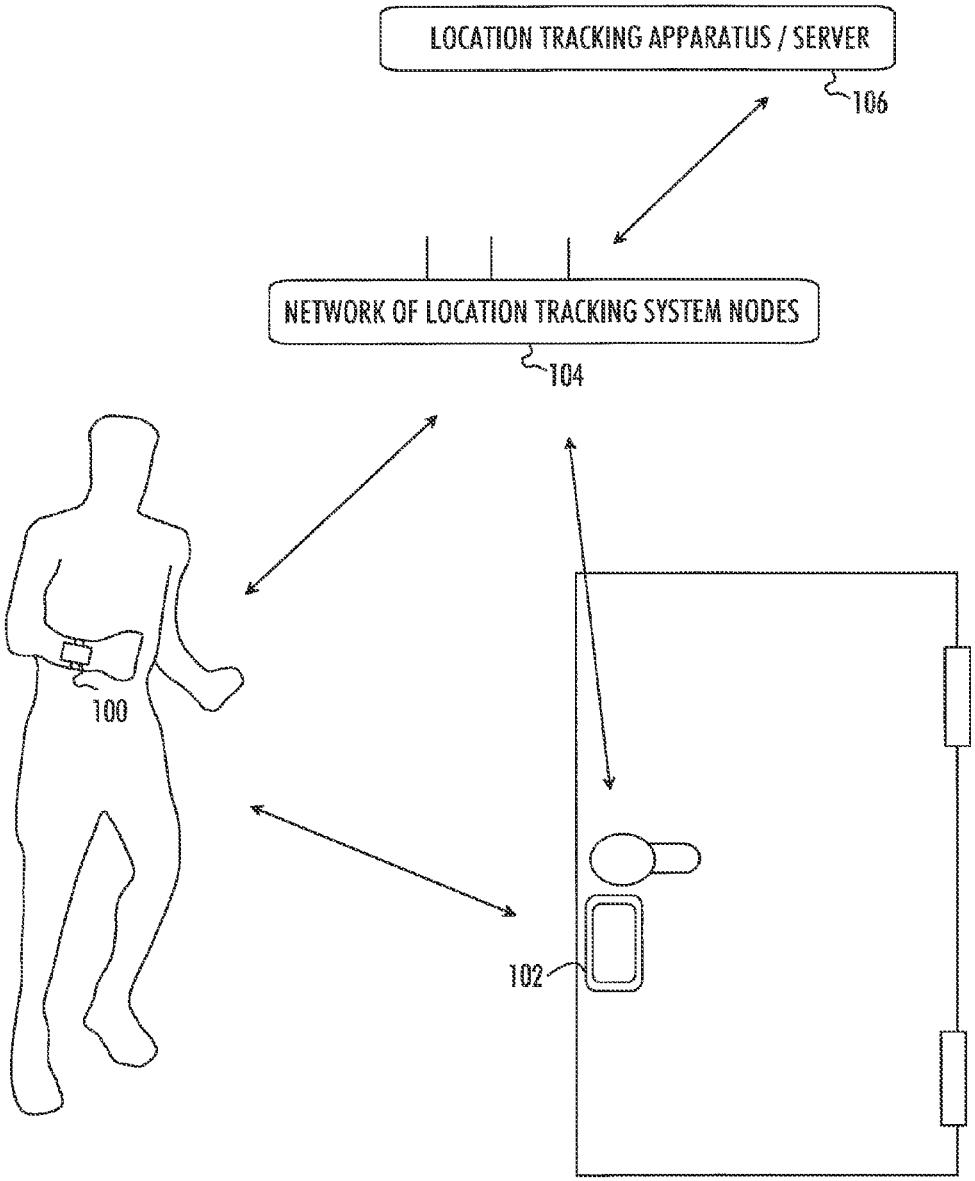

FIG. 1 illustrates a general scenario to which embodiments of the invention may be applied. Referring to FIG. 1, a system according to an embodiment of the invention comprises a location tracking system (LTS) which may be an indoor or outdoor location tracking system. A plurality of LTS nodes 104 may be disposed throughout an area in which the location tracking is carried out. The LTS nodes 104 may be radio communication devices, each configured to provide a coverage area, and the combined coverage areas of the LTS nodes 104 cover the location tracking area. The LTS nodes 104 may also form a mesh network enabling data routing between the nodes 104 and through the nodes 104. A location tracking apparatus that may be comprised in a server 106 may be connected to the network of LTS nodes 104, and the location tracking apparatus may be configured to maintain locations of tracked objects and control the location tracking and other features of the LTS. The server and the location tracking apparatus 106 may be realized by a computer provided with suitable communication equipment so as to enable a communication connection with the LTS nodes 104. The server 106 may be connected to a router via an Internet Protocol (IP) connection, and the router may be configured to connect to the mesh network of LTS nodes 104 through another connection type. The connection in the mesh network of LTS nodes 104 may be configured to establish the mesh network according to a Bluetooth technology, but it should be understood that other radio communication schemes may be used as well.

The locations of objects are tracked by tracking movement of mobile tags attached to the objects. For example, a user tag 100 may be carried by a person, and an asset tag may be attached to an asset. The asset may be any mobile or portable apparatus that is wanted to be tracked, e.g. a wheelchair, a computer, or expensive industrial testing equipment. The asset tag may equally be attached to a fixed apparatus, e.g. a safe, a projector, in order to detect attempted robbery. The different tags whose movement and location are tracked may be called generally mobile tags. The location tracking may be based on a scheme where a mobile tag is configured to detect the closest LTS node and to transmit to the server periodically a message comprising an identifier of the mobile tag and an identifier of the detected closest LTS node. The message may be routed through the mesh network of LTS nodes 104 to the server 106. As the server 106 is provided with information on fixed locations of the LTS nodes, e.g. in a layout of the area, the server is able to associate the mobile tag with the LTS node on the basis of the received message and, thus, determine the location of the mobile tag and the object associated with the mobile tag. In another embodiment, an LTS node is configured to detect mobile tags in its coverage area and transmit periodically identifiers of detected mobile tags to the server. The detection of the LTS nodes or mobile tags may be based on Bluetooth inquiry procedure. The LTS may, however, utilize another location tracking scheme and/or another communication scheme.

The premises of the location tracking system may comprise access-controlled entities, e.g. doors, cabinets, safes, and electronic devices. The LTS according to embodiments of the invention comprises access control apparatuses 102 connected to at least some of the access-controlled entities. The access control apparatus 102 is part of the LTS in the sense that it is configured to communicate with the server 106 through the mesh network of the LTS nodes 104, for example. The server may store access rights for the mobile tags 100. The access control apparatus 102 is further configured to communicate wirelessly with the mobile tags 100 over a radio interface, e.g. over Bluetooth connections. Other radio access schemes are naturally possible, depending on the radio access scheme(s) utilized by the LTS. The access control apparatus 102 is configured to communicate with the mobile tags and the server in order to verify whether or not the mobile tags 100 have access rights to the access-controlled entity connected to the access control apparatus 102. Upon determining that a given mobile tag 100 has the appropriate rights (may be verified from the server 106), the access control apparatus 102 is configured to grant access to the access-controlled entity by opening a mechanical or electromechanical lock and/or by configuring an electronic equipment to activate and grant operating access, e.g. by logging a user of the mobile tag in. When the mobile tag 100 does not have the appropriate rights, the access control apparatus 102 is configured to deny the access and maintain the locking of the access-controlled entity. At least some of the access control apparatuses 102 may comprise the functionality LTS node and, accordingly, such an apparatus functions as the LTS node and as the access control apparatus 102.

Figure 2A:
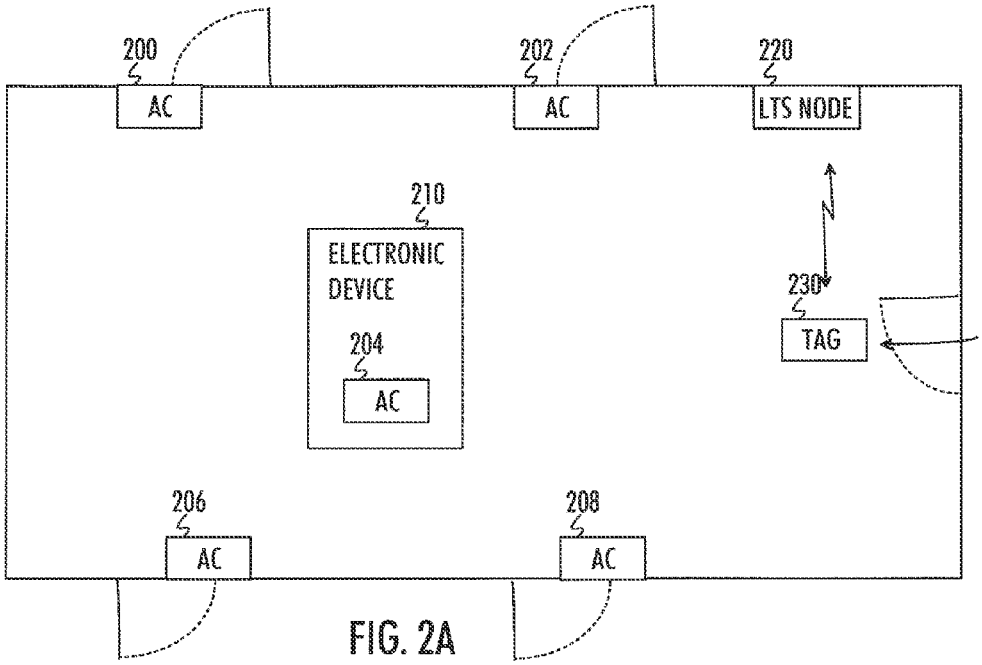
FIGS. 2A and 2B illustrate an embodiment for negotiating access rights in the location tracking system.
Figure 2B:
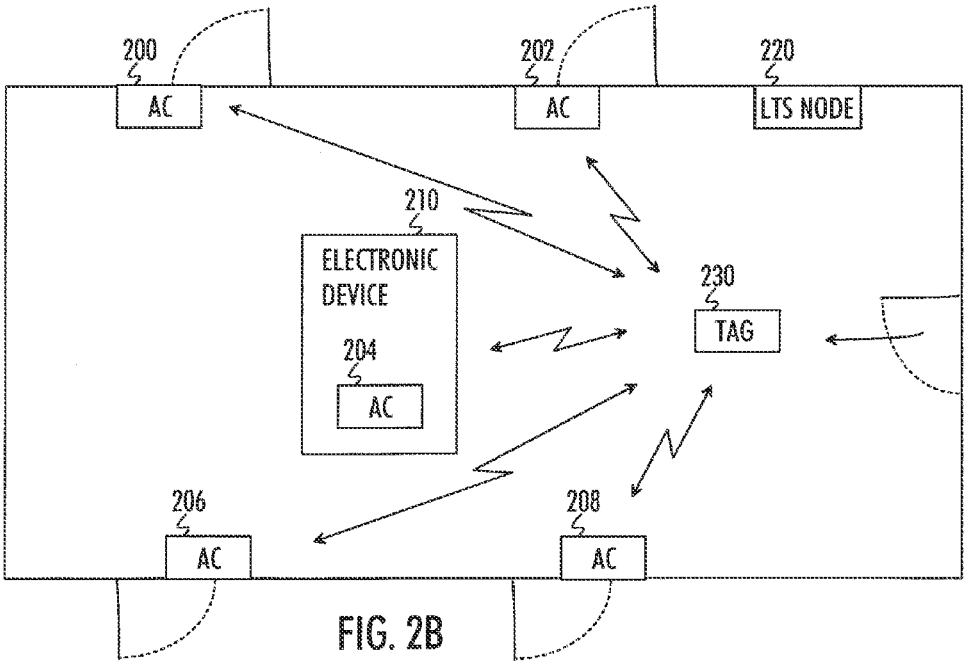

FIGS. 2A and 2B illustrate an embodiment of carrying out access control in the LTS. FIGS. 2A and 2B illustrate a layout of a room provided with a plurality of access-controlled entities (doors and an electronic device 210). Each access-controlled entity is connected to a separate access control apparatus 200, 202, 204, 206, and 208. The room further comprises an LTS node 220 to enable positioning mobile tags (e.g. a mobile tag 230) in the room. Let us assume that the mobile tag 230 enters the room. Thereafter, the mobile tag and/or the LTS node 220 carries out routine location update procedure in which the mobile tag 230 becomes linked to the LTS node 220, and its location is updated to the room (FIG. 2A). In response to the location update, the location tracking apparatus 106 of the LTS detects that the mobile tag is located in the room with the access control apparatuses 200 to 208. Upon said detection, the location tracking apparatus 106 transmits an activation signal to the access control apparatuses 200 to 208 to activate a connection establishment procedure with the mobile tag 230. The access control apparatuses 200 to 208 may thus initiate transmission of Bluetooth Inquiry request messages, for example. The location tracking apparatus 106 may also provide the access control apparatuses 200 to 208 with an identifier of the mobile tag 230. The location tracking apparatus 106 may also activate the mobile tag 230 to initiate the connection establishment procedure, e.g. by starting a Bluetooth Inquiry Scan procedure in which the mobile tag scans for Inquiry Request and responds to them by transmitting Inquiry Responses. The Inquiry Response may be an Extended Inquiry Response according to Bluetooth 2.1 (and later versions), wherein the mobile tag is configured to filter devices to which connect. For example, the mobile tag may include in the Extended Inquiry Response an information element that indicates that the mobile tag is configured to pair with an access control apparatus. As a consequence, devices other than the access control apparatuses are filtered out, and pairing with the access control apparatuses is facilitated. It should be noted that in other embodiments using other radio connection protocols, another equivalent information element used for indicating a class of devices with which the connection is to be established may be used.

With some radio access schemes, the connection establishment may last for several seconds and, therefore, it may be advantageous to start the connection establishment upon detection of a possible access attempt, e.g. by detecting the presence of a user in a given room. Establishment of the connection before the actual access attempt facilitates and expedites the actual access. Furthermore, the embodiments of the present invention enable a smart access where the user does not have to find a key to carry out the access. The negotiation about the access rights may be carried out without user intervention by utilizing the location tracking system to trigger the negotiation about the access rights of the user. In other words, the location tracking apparatus 106 autonomously triggers the access control apparatus 200 to 208 and the mobile tag 230 to negotiate about the access rights, and the access may be granted autonomously on the basis of the negotiation.

Figure 3:
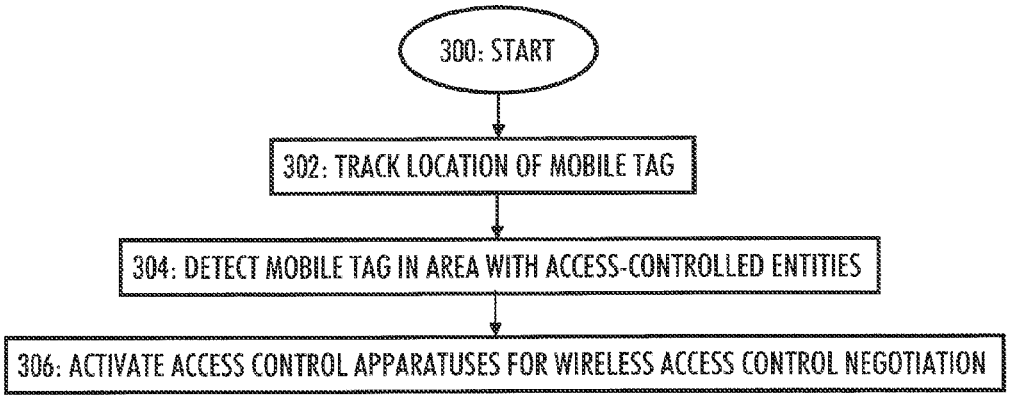
FIG. 3 illustrates a flow diagram of a process for activating an access control apparatus to negotiate about access rights of a mobile tag.

FIG. 3 illustrates an embodiment of a process for controlling access in a location tracking system. The process may be carried out by the location tracking apparatus 106. The process starts in block 300. In block 302, the location tracking apparatus tracks locations of a mobile tag 230 in a coverage area of the LTS. Obviously, the location tracking apparatus 106 tracks the location of multiple mobile tags 100, 230, but let us concentrate to the mobile tag 230 for the sake of clarity. In block 304, the location tracking apparatus detects the presence of the mobile tag 230 in a determined area comprising at least one access-controlled entity, wherein each access-controlled entity is associated with an access control apparatus 200 to 208 controlling the access or entry to the access-controlled entity. The area may be a room or part of the room, a corridor, a hall, a warehouse, etc. In response to the detection of the mobile tag 230 in the determined area, the location tracking apparatus 106 is configured in block 306 to activate the access control apparatus 200 to 208 to initiate establishment of a wireless communication connection with the mobile tag 230 so as to negotiate about access to the access-controlled entity. The activation is carried out by transmitting an activation signal from the location tracking apparatus to the access control apparatus.

The access control in the context of the present invention combines features of a location tracking system and an access control system. The location tracking system may provide an arbitrary accuracy to the location tracking, as defined by the number of LTS nodes disposed in the coverage area of the LTS. Typically, the accuracy is designed to outperform an access control system registering the users that have operated the lock, for example. Such access control systems provide very ambiguous location for the user, as they cannot monitor the location of those users that have entered a door without operating the lock and/or if the user who operated the lock and opened the door actually passed the door. Therefore, they cannot provide the advantages of the LTS. The activation of the access control apparatus 102, 200 to 208 by the location tracking apparatus 106 when a mobile tag 100, 230 is detected in the premises of the access control apparatus 102, 200 to 208, e.g. in the same room or within a determined distance (as determined through accessible routes and not through walls, floors, and ceilings, for example), enables hibernation of the access control apparatus 102, 200 to 208 when there are no mobile tags 100, 230 close by. This reduces the power consumption and SAR (specific absorption rate) caused by the transmitter of the access control apparatus. There may be people without the mobile tags 100, 230 in the premises of the location tracking apparatus 106, and the present invention reduces the SAR values for such people.

Figure 4:
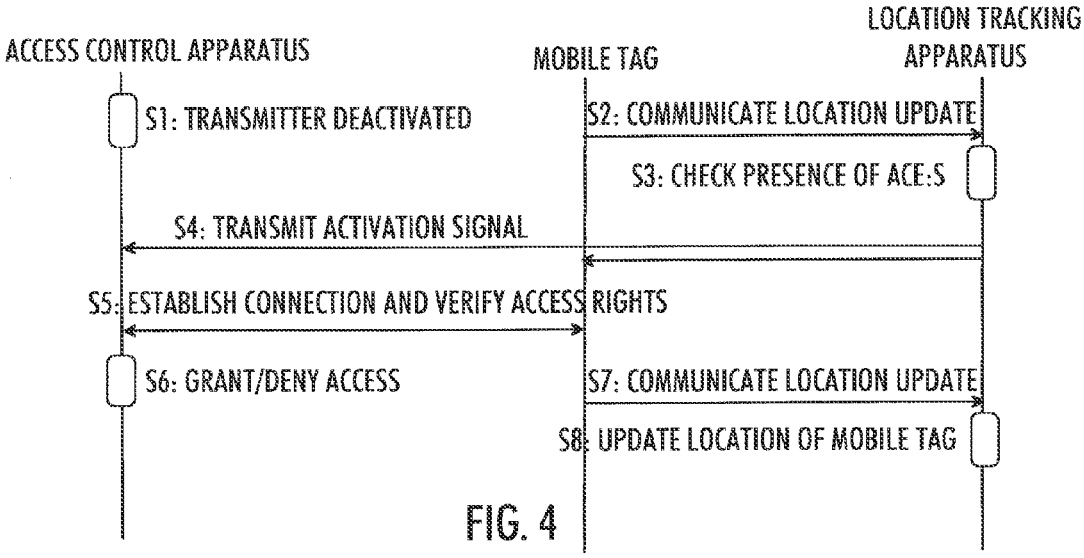
FIGS. 4 and 5 illustrate signaling diagrams related to embodiments for carrying out access control in a location tracking system.

FIG. 4 illustrates a signaling diagram of an embodiment of an access control process 106 in the LTS. The process includes operations carried out in the location tracking apparatus 106, the mobile tag 100, 230 and the access control apparatus 102, 200 to 208, and communication between these devices. In S1, the transmitter of the access control apparatus is deactivated to reduce the power consumption and avoid electromagnetic radiation in the premises of the access control apparatus. Meanwhile, the location tracking apparatus tracks the location of the mobile tag. In S2, the location tracking apparatus receives a location update message related to the mobile tag from the mobile tag itself or from an LTS node. In S3, in response to the location update where the current location of the mobile tag is changed in a location database maintained by the location tracking apparatus, the location tracking apparatus checks the presence of access-controlled entities in the area to which the mobile tag was mapped. Let us assume that the location update maps the mobile tag to an area where the access control apparatus is located. Upon detecting that the mobile tag is in an area where the access control apparatus is, the location tracking apparatus activates the access control apparatus to initiate establishment of the connection with the mobile tag in S4. The location tracking apparatus may transmit an activation signal or activation message to the access control apparatus in S4 over the mesh network of LTS nodes. In other embodiments, a wired line is provided between the access control apparatus and the server, and the communication between the access control apparatus and the server is carried out over the wired line. In S4, the location tracking apparatus may also activate the mobile tag to initiate establishment of the connection(s) with the location control apparatus(es) by transmitting an activation signal or an activation message to the mobile tag over the mesh network, for example. In response to the received activation, the access control apparatus and the mobile tag are configured to carry out pairing by establishing the communication connection. The pairing may be carried out through Bluetooth Extended Inquiry process by using the device filtering, as described above. The connection may be a Bluetooth Logical Link Control and Adaptation Protocol (L2CAP) connection, and the connection may be used to exchange an identifier in order to verify the access rights of the mobile tag to the access-controlled entity controlled by the access control apparatus. The mobile tag may be configured to transmit its identifier, e.g. a Bluetooth device identifier, to the access control apparatus, and the access control apparatus may be configured to verify the access rights of the mobile tag by communicating the received identifier to the server 106. The server 106 may store an access rights database comprising access rights to multiple mobile tags. If the database shows that the identifier of the mobile tag is granted with rights to access the access-controlled entity, the server 106 may return an Access Confirmed message to the access control apparatus. Otherwise, the server 106 may return an Access Rejected message to the access control apparatus. In response to the reception of the Access Confirmed message, the access control apparatus may then grant access to the user of the mobile tag to the access-controlled entity in S6. This may comprise opening an electromechanical lock or allowing the user an access to an electronic device. In response to the reception of the Access Rejected message, the access control apparatus may deny access to the access-controlled entity in S6. This may comprise providing a rejection signal through output device of the access control apparatus, e.g. signing a red light or otherwise visually signaling the denied access.

In another embodiment, the access control apparatus may be configured to transmit its identifier, e.g. a Bluetooth device identifier, to the mobile tag, and the mobile may be configured to request access rights to the access-controlled entity identified by the received identifier by communicating the received identifier to the server 106. If the database shows that the identifier of the mobile tag is granted with rights to access the access-controlled entity, the server 106 may return an Access Confirmed message to the access control apparatus. Otherwise, the server 106 may return an Access Rejected message to the access control apparatus. In response to the reception of the Access Confirmed message, the mobile tag may be configured to control the access control apparatus to grant the access. The server may, for example, return a specific code word that configures the access control apparatus to grant the access. In response to the Access Rejected message, the mobile tag may indicate the failed access to the user through a user interface of the mobile tag.

In S7, the location of the mobile tag is again updated, and the location tracking apparatus updates the location of the mobile tag in its database. The location tracking apparatus may in steps S7 and S8 verify whether or not the mobile tag has entered through a given access-controlled door. In other words, the system may be used to grant access to open doors and to verify that the user has actually entered through the door.

Figure 5:
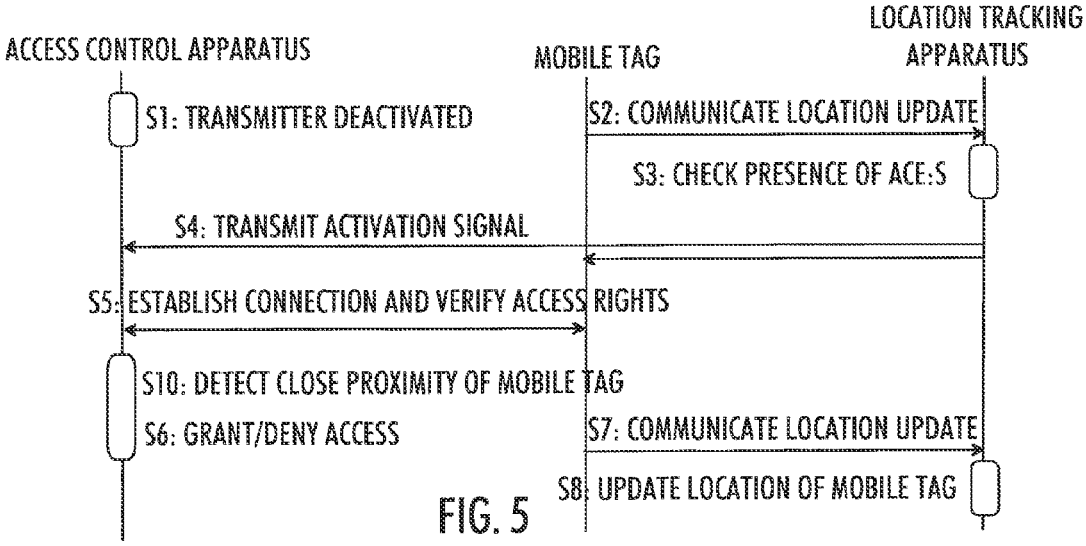

FIG. 5 illustrates another embodiment where the proximity of the mobile tag is verified before granting access by opening the lock to the door, for example. The steps denoted by the same reference signs as in FIG. 4 have corresponding functionalities. The verification of the access rights may be carried out in connection with the connection establishment in S5. Thereafter, the connection may be put on hold or maintained. With respect to Bluetooth, the Bluetooth connection may be put on a Bluetooth park mode between the completed verification and the opening the lock (or otherwise physically granting the access). The access control apparatus may be provided with a proximity sensor configured to detect close proximity of mobile tags. The proximity sensor may be a Hall sensor triggered by bringing the mobile tag (comprising ferrite/magnetic material) within close proximity of the Hall sensor. Other embodiments utilize other proximity sensor based on measurement of signal strength from the mobile tag. In some embodiments, the proximity sensor may be a button or another input device to which a user of the mobile tag may enter an input to indicate the close proximity. In other embodiments, the user may press a button on the mobile tag, which triggers transmission of a proximity indication signal to the access control apparatus over the established communication connection. In further embodiments, the proximity sensor comprises a near-field communications (NFC) unit. The NFC is a bidirectional short-range communication protocol based on radio-frequency identification (RFID), wherein a user may trigger the NFC communication by bringing the mobile tag provided with an NFC unit in close proximity with the NFC unit of the access control apparatus. An operational range of the proximity sensor may be one meter, a few meters, or less. Referring to FIG. 5, the close proximity of the mobile tag is detected in S10, and the access control apparatus is configured to grant or deny access upon detecting the close proximity of the mobile tag. In some embodiments, the access control apparatus is configured to verify that the mobile tag detected close to the access control apparatus is the mobile tag whose access rights were verified in S5. This may include input of a code word through the input device of the access control apparatus, input of a biometric input, e.g. a fingerprint through biometric input device of the access control apparatus. In some embodiments where the proximity sensor is the Hall sensor, the verification may include transmitting a code word from the mobile tag to the access control apparatus through magnetic interface provided between the mobile tag and the Hall sensor of the access control apparatus. Magnetic transmissions as such are known in the art as means for conveying information wirelessly. The verification may include transmission of a determined waveform inductively to the Hall sensor, and the access control apparatus may verify whether or not the waveform is valid for access grant. In some embodiments, the server may periodically change the waveform and signal an index of a new waveform to the mobile tags. This waveform is then used in the verification using the inductive verification. This ensures that the access cannot be gained by using simple magnetic triggering of the Hall sensor without the correct waveform. In the embodiments where the proximity sensor utilizes the NFC, the exchange of the code word or the waveform may be implemented by using the NFC transmissions. Upon successful verification after the detection of the close proximity of the mobile tag, the access control apparatus grants the access in S6.

The verification of the rights in an early phase in S5 enables that the access rights negotiation is carried out as soon as possible. The verification may be carried out even before it is clear which one of a plurality of access-controlled entities the user of the mobile tag intends to access (if any). As a consequence, the verification of the access rights may be triggered when the mobile tag is detected to enter a wireless communication range of the access control apparatus or within a given distance from an edge of the wireless communication range of the access control apparatus. On the other hand, the detection of the close proximity of the mobile tag and reverification of the access rights ensures that no person other than the one having the access rights is able to gain faulty access.

Figure 6:
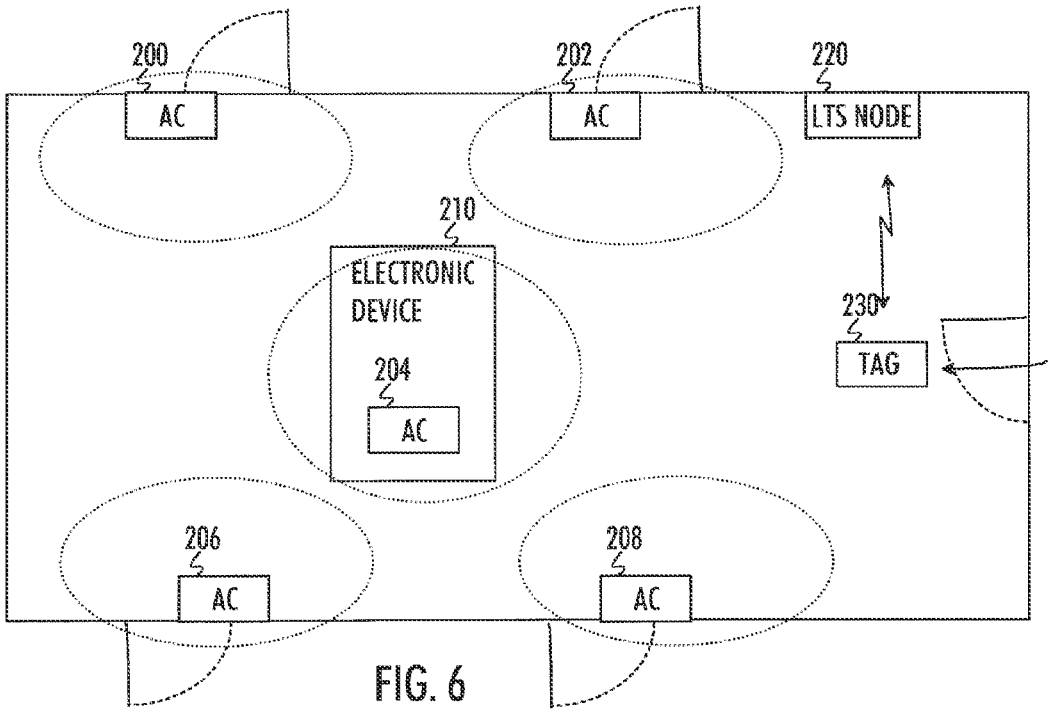
FIGS. 6 and 7 illustrate embodiments for configuring coverage areas of a plurality of access control apparatuses disposed in the same limited area.
Figure 7:
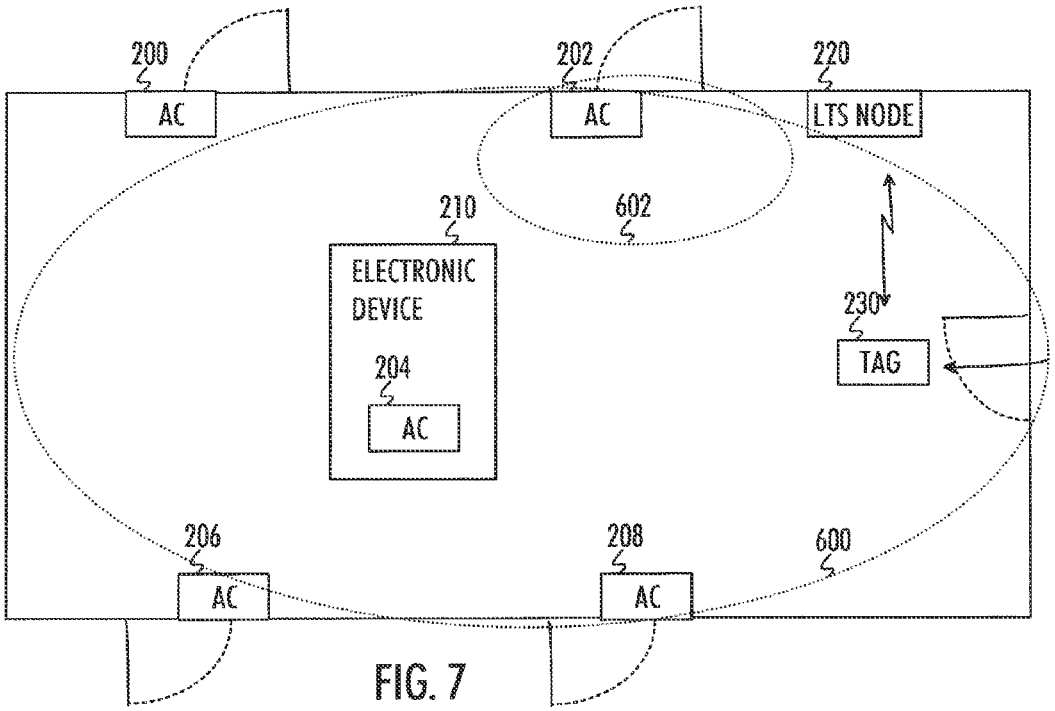

FIGS. 6 and 7 illustrate further embodiments for the proximity detection. Referring to FIG. 6, in some embodiments, the wireless communication ranges of the access control apparatuses are designed such that their coverage areas do not overlap. The operational range of the access control apparatuses may be a few meters, e.g. less than meters, such that when the user enters the coverage area, it is highly probable that the user accesses the corresponding access-controlled entity. When the mobile tag 230 is registered to enter the room, the location tracking apparatus activates the access control apparatuses 200 to 208. When a given access control apparatus is able to establish the connection with the mobile tag, it may be configured to carry out the verification and immediately grant/deny access to the access-controlled entity. In these embodiments, as the coverage areas do not overlap, it may be ensured that the access is granted at the correct timing and, for example, a wrong door will not be opened.

FIG. 6 illustrates an embodiment of two-phase operation of the access control apparatus 202. In this embodiment, upon reception of the activation message from the location tracking apparatus, the access control apparatus is configured to establish the communication connection with the mobile tag by using a first transmission power. Upon establishment of the connection, the verification of the access rights may be performed (step S5). Upon completed verification, the connection may be put on hold. Upon detection of the close proximity of the tag, the access control apparatus is configured to carry out a verification procedure comprising communication with the mobile tag by using a second transmission power lower than the first transmission power. This enables verification that the mobile tag in close proximity of the access control apparatus is the correct mobile tag to which the access rights were verified. Thereafter, the access control apparatus may grant access to the mobile tag, if the tag is allowed to access the access-controlled entity and if the verification procedure results in successful communication between the access control apparatus and the mobile tag. The first transmission power may provide the access control apparatus with a first coverage area 600 that essentially covers a large area around the access control apparatus, e.g. the room. The first coverage area may cover an area in which other access control apparatuses may be located. The second transmission power may provide the access control apparatus with a second coverage area 602 that covers essentially smaller area around the access control apparatus. The second coverage area 602 may be one meter or less or two meters or less, and only the single access control apparatus (having the coverage area) may be located in the second coverage area.

Figure 8:
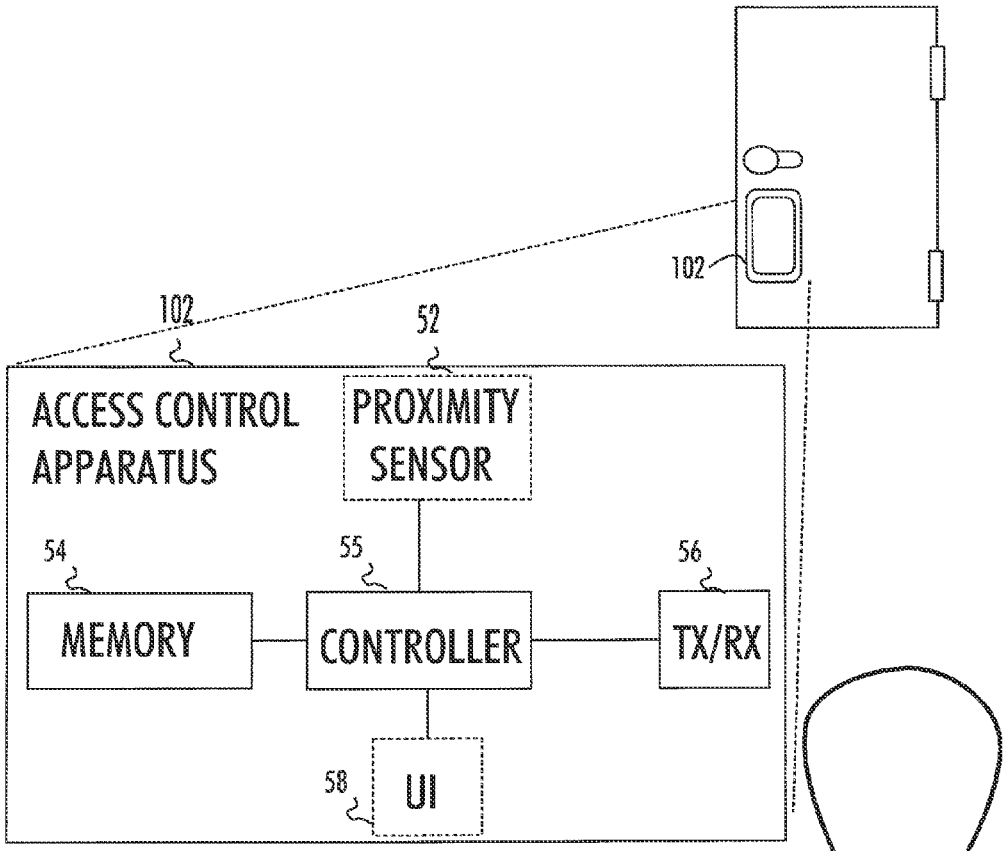
FIGS. 8 to 10 illustrate block diagrams of devices configured to realize the access control in the location tracking system according to some embodiments of the invention.
Figure 9:
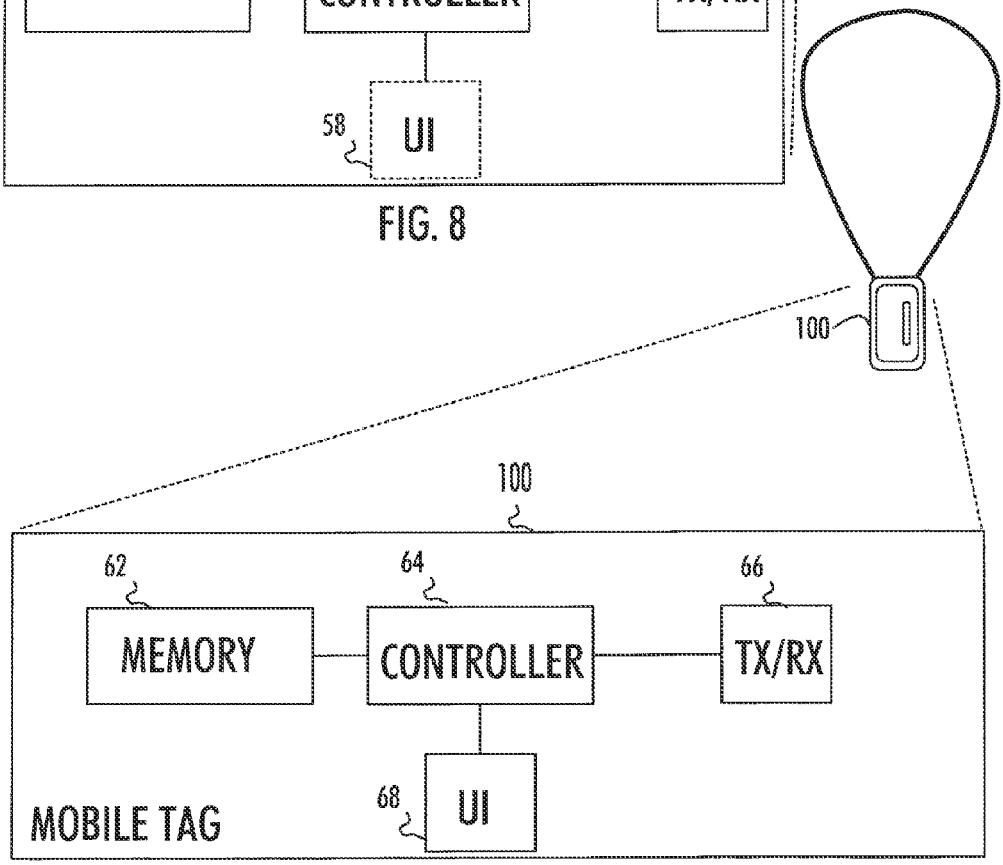

FIGS. 8 and 9 illustrate wireless communication devices according to embodiments of the invention. FIG. 8 illustrates an embodiment of the access control apparatus 102, which may be installed to a door as operationally connected with a lock of the door. In other embodiments, access control apparatus 102 may be installed to an electronic device as operationally connected to the device through an input/output interface (e.g. Universal Serial Bus, RS-485, Wiegand, or a combination of a physical layer of RS-485 and other communication protocol(s) of Wiegand) of the electronic device so as to control electronic locking and access to operate the electronic device. The access control apparatus 102 may comprise a casing and a fixing mechanism used for attaching the access control apparatus 102 to the access-controlled entity, e.g. the door or the electronic equipment. The access control apparatus 102 may comprise in the casing a communication circuitry 56 configured to carry out the communications with the server and the mobile tags as described above. The communication circuitry 56 may support Bluetooth communication technology, for example. The communication circuitry 56 may also be understood to comprise means for interacting with the access-controlled entity so as to communicate a command for opening the electro-mechanical lock or logging in or otherwise granting access to the electronic equipment. In an embodiment, the communication circuitry 56 may be configured to apply a plurality of transmission power levels for the wireless communications, as described above.

The access control apparatus 102 further comprises a controller circuitry 55 configured to control the operation of the access control apparatus. The controller circuitry 55 may be configured to control the operational status of the access control apparatus. For example, in response to the reception of the activation signal from the server, the controller circuitry 55 may be configured to activate the transmitter of the communication circuitry 56. On the other hand, in response to detection of no mobile tags in the coverage area of the communication circuitry 56, the controller circuitry 55 may be configured to deactivate the transmitter. In other embodiments, the transmitter is deactivated according to another criterion, e.g. reception of a deactivation signal from the server when the location tracking apparatus detects no mobile tags in the area of the access control apparatus 102. The controller circuitry 55 may be configured to communicate with the server and the mobile tag so as to verify the access rights of the mobile tag, as described above. The controller circuitry may also be configured to carry out reverification in response to detection of the close proximity of the mobile tag with respect to the access control apparatus, as described above. The access control apparatus may comprise the proximity sensor 52 to detect the close proximity of the mobile tags. The controller circuitry 55 may also control the transmit power of the communication circuitry 56 and/or trigger the operation of the NFC communication circuitry. The controller circuitry 55 may also control the communication with the lock or the electronic equipment through the input/output interface (e.g. RS-485, Wiegand, or their combination) so as to grant access. The controller circuitry 55 may comprise a processor configured by software read by the processor from a memory unit 54. The memory 54 may also store operational parameters for the access control apparatus. The memory may store, for example, the access rights of the mobile tags of the LTS so that the communication with the server may be omitted, when verifying the access rights of the mobile tag, by replacing the communication with the server with a memory reading operation. The server may periodically update the access rights. The mobile tag 102 may further comprise a user interface 58 comprising a loudspeaker and/or a visual interface, e.g. in the form of lights or a display unit and, optionally, an input device comprising one or more buttons. The controller circuitry 55 and the communication circuitry 56 in cooperation may be understood as forming means for carrying out the above-described functionalities of the access control apparatus. In some embodiments, the means for carrying out the above-described functionalities of the mobile tag may comprise other components of the mobile tag (the Hall sensor, NFC communication circuitry, the user interface, etc.), depending on the embodiment. a proximity sensor 52 configured to output a signal triggering the establishment of the D2D communication connection upon detection of a determined change in monitored magnetic field.

FIG. 9 illustrates an embodiment of the mobile tag 100 The mobile tag 100 may comprise a casing and a strap used for attaching the mobile tag 100 around a neck or a wrist of a user in order to carry it conveniently. The mobile tag 100 may equally be attached to another personal electronic device carried or worn by the user, e.g. a mobile phone, a laptop, or a piece of clothing. The mobile tag 100 comprises a communication circuitry 66 configured to enable communication connections with the access control apparatuses and with the LTS nodes and the server in order to carry out the location tracking and the request and gain access according to embodiments of the invention. The mobile tag 100 may further comprise a controller circuitry 64 configured to control the operations of the mobile tag 100 according to embodiments of the invention. The controller circuitry 64 may be configured to carry out the process according to any embodiment described above in connection with the mobile tag 100. The controller circuitry 64 may comprise a processor configured by software read by the processor from a memory unit 62. The mobile tag 102 may further comprise a user interface 68 comprising an input device such as a keypad or buttons, output means such as a loudspeaker and/or a visual interface, e.g. in the form of lights or a display unit. In an embodiment, the mobile tag 100 comprises an interface to be connected to a counterpart interface of another electronic device, e.g. a mobile phone or a computer (laptop). In such embodiments, the user interface 68 of the mobile tag 100 may utilize an expanded user interface provided by the other electronic device. For example, the mobile tag 100 itself may be provided with no display, but when the mobile tag 100 is connected to the other electronic device comprising a display, the controller circuitry 64 is configured to detect the connection and provide the user with a visual display, e.g. a menu, through the display of the electronic device. The controller circuitry 64 and the communication circuitry 66 in cooperation may be understood as forming means for carrying out the above-described functionalities of the mobile tag. In some embodiments, the means for carrying out the above-described functionalities of the mobile tag may comprise other components of the mobile tag, e.g. the user interface, depending on the embodiment.

Figure 10:
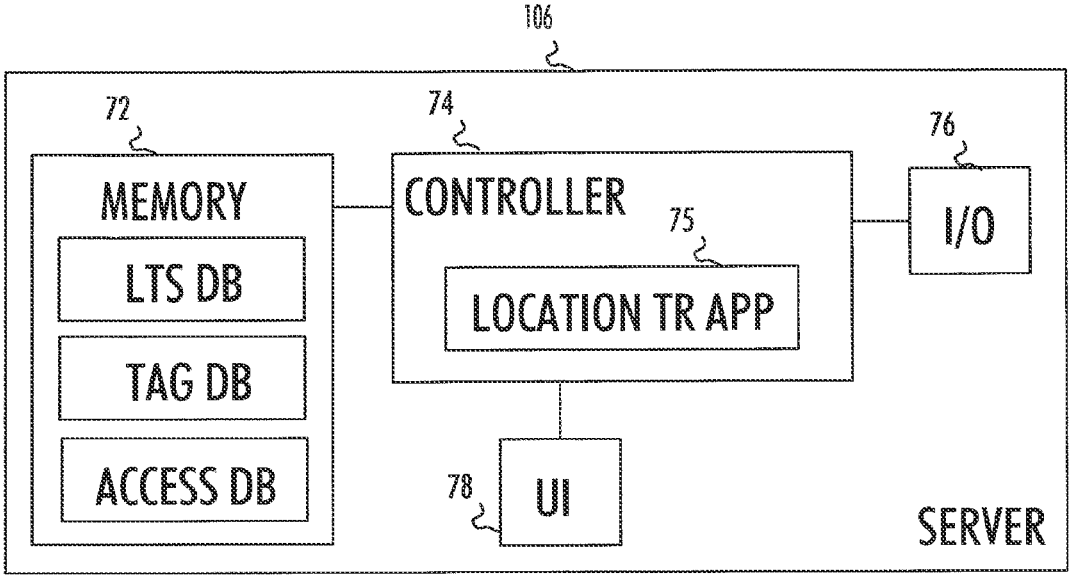

FIG. 10 illustrates a block diagram of an embodiment of the server 106. The server 106 comprises an input/output (I/O) interface 76 enabling a communication connection with the wireless communication devices of the LTS, e.g. the mobile tags, other tags, LTS nodes, and the access control apparatuses. The I/O interface 76 may provide the server with Internet protocol connectivity. The server 70 may further comprise a controller circuitry 74 configured to carry out the embodiments described above in connection with the server. The controller circuitry 74 may comprise as a sub-circuitry the location tracking apparatus 75, which may be understood as a sub-routine or computer program configuring the controller circuitry to carry out the functionalities of the location tracking apparatus 75. The controller circuitry 74 may comprise a processor configured by software read by the processor from a memory unit 72. The memory unit 72 may also store databases needed for the implementation of the LTS and maintaining the access rights. The databases may comprise an LTS database storing current locations of the tags being location-tracked, a layout of the area in which the location tracking is carried out, etc. The memory 72 may further store a tag database storing identifiers of the tags comprised in the LTS and any personal and/or asset information associated with the tags. The tag database may link the tags to corresponding users and assets. The memory 72 may also store an access rights database storing current access rights of the mobile tags. The access rights database may comprise information that enables determination of the access-controlled entities and/or access control apparatuses to which each mobile tag has and has not the access rights. The memory 72 may be realized by a single memory device or a plurality of memory devices which may be structurally different including, for example but not limited to, a hard drive, a random access memory, and flash memory. The server 70 may further comprise a user interface 78 comprising a display unit, a keyboard, a mouse, a loudspeaker, and/or similar input and/or output means.

As used in this application, the term 'circuitry' refers to all of the following: (a) hardware-only circuit implementations, such as implementations in only analog and/or digital circuitry, and (b) to combinations of circuits and software (and/or firmware), such as (as applicable): (i) a combination of processor(s) or (ii) portions of processor(s)/software including digital signal processor(s), software, and memory(ies) that work together to cause an apparatus to perform various functions, and (c) to circuits, such as a microprocessor(s) or a portion of a microprocessor(s), that require software or firmware for operation, even if the software or firmware is not physically present. This definition of 'circuitry' applies to all uses of this term in this application. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular element, a baseband integrated circuit or applications processor integrated circuit for a mobile phone or a similar integrated circuit in server, a cellular network device, or other network device.

The processes or methods described in connection with FIGS. 2 to 7 may also be carried out in the form of a computer process defined by a computer program. The computer program may be in source code form, object code form, or in some intermediate form, and it may be stored in some sort of carrier, which may be any entity or device capable of carrying the program. Such carriers include a record medium, computer memory, read-only memory, electrical carrier signal, telecommunications signal, and software distribution package, for example. Depending on the processing power needed, the computer program may be executed in a single electronic digital processing unit or it may be distributed amongst a number of processing units. As the present invention comprises features in the location tracking apparatus, the access control apparatus, and the mobile tag, each apparatus may be provided with a processor configured by a separate computer program product.

The present invention is applicable to location tracking systems defined above but also to other suitable location tracking systems. Communication protocols and specifications of location tracking systems, their elements and tags may vary and develop as the technology advances. Such development may require extra changes to the described embodiments. Therefore, all words and expressions should be interpreted broadly and they are intended to illustrate, not to restrict, the described embodiments. It will be obvious to a person skilled in the art that, as technology advances, the inventive concept can be implemented in various ways. The invention and its embodiments are not limited to the examples described above but may vary within the scope of the claims.

The invention claimed is:

1. A method for controlling access in a location tracking system using a location tracking apparatus comprising a radio network of location tracking nodes disposed in a predetermined coverage area, and an access control apparatus configured to communicate with the location tracking apparatus via the radio network of the location tracking nodes, the method comprising:

tracking, by the location tracking apparatus, a location of at least one mobile tag in the predetermined coverage area of the location tracking system based on a location update message from the mobile tag or from at least one of the location tracking nodes, wherein the location tracking apparatus comprises a plurality of wireless transceivers operating as said location tracking nodes;

detecting presence of the mobile tag, by the location tracking apparatus on the basis of a current association between the mobile tag and at least one of the location tracking nodes in a determined area, of the predetermined coverage area, associated with said at least one of the locations tracking nodes and at least one access-controlled entity, wherein each access-controlled entity is associated with the access control apparatus deactivated during the detection; and transmitting an activation signal from the location tracking apparatus to the access control apparatus in response to the detection of the mobile tag in the determined area, in order to activate the access control apparatus to initiate establishment of a wireless communication connection between the mobile tag and the access control apparatus so as to negotiate about access to the access-controlled entity.

2. The method of claim 1, further comprising:

deactivating a transmitter of the access control apparatus when no mobile tag is detected in the determined area; and in response to the detection of the mobile tag in the determined area, activating the transmitter of the access control apparatus to transmit a connection establishment signal.

3. The method of claim 1, wherein the wireless transceivers form a wireless communication network connecting the location tracking apparatus to the mobile tag, and wherein the at least one of the activation signals is transmitted through the wireless communication network.

4. The method of claim 1, further comprising:

configuring the access control apparatus to establish the communication connection with the mobile tag by using a first transmission power;

carrying out a verification procedure comprising communication with the mobile tag by using a second transmission power lower than the first transmission power, thus enabling verification whether or not the mobile tag is in close proximity of the access control apparatus; and granting access to the mobile tag, if the tag is allowed to access the access-controlled entity and if the verification procedure results in successful communication between the access control apparatus and the mobile tag.

5. The method of claim 4, wherein the communication connection between the access control apparatus and the mobile tag is maintained or put on hold between the establishment of the communication connection and the verification procedure.

6. The method of claim 4, further comprising:

detecting, by a proximity sensor provided in the access control apparatus, a close proximity of the mobile tag with respect to the access control apparatus; and triggering the verification procedure by the detection of the close proximity of the mobile tag.

7. The method of claim 1, wherein the determined area comprises a plurality of access control entities.

8. A location tracking system comprising:

a location tracking apparatus comprising a radio network of location tracking nodes disposed in a predetermined coverage area;

an access control apparatus configured to communicate with the location tracking apparatus via the radio network of the location tracking nodes;

the location tracking apparatus further comprising:

at least one processor; and at least one memory including program instructions, wherein the at least one memory and the computer program code are configured, with the at least one processor, to cause the location tracking apparatus to:

track a location of at least one mobile tag in the predetermined coverage area of the location tracking system based on a location update message from the mobile tag or from at least one of the location tracking nodes, wherein the location tracking apparatus comprises a plurality of wireless transceivers operating as said location tracking nodes;

detect, on the basis of a current association between the mobile tag and at least one of the location tracking nodes in a determined area, of the predetermined coverage area, associated with said at least one of the location tracking nodes and at least one access-controlled entity, wherein each access-controlled entity is associated with access control apparatus deactivated during the detection; and transmit an activation signal from the location tracking apparatus to the access control apparatus, in response to the detection of the mobile tag in the determined area, in order to activate the access control apparatus to initiate establishment of a wireless communication connection between the mobile tag and the access control apparatus so as to negotiate about access to the access-controlled entity.

9. The system of claim 8, the access control apparatus further comprising:

a transceiver;

at least one processor; and at least one memory including program instructions, wherein the at least one memory and the computer program code are configured, with the at least one processor, to cause the access control apparatus to:

communicate with the mobile tag and the location tracking apparatus, to deactivate a transmitter of the transceiver when no mobile tag is detected in the determined area and, in response to the detection of the mobile tag in the determined area, to activate the transmitter to transmit a connection establishment signal.

10. The system of claim 8, the mobile tag further comprising:

at least one processor; and at least one memory including program instructions, wherein the at least one memory and the computer program code are configured, with the at least one processor, to cause the mobile tag to, in response to the detection of the mobile tag in the determined area, initiate establishment of the wireless communication connection with the at least one access control apparatus in the determined area, wherein the location tracking apparatus is further configured to activate the mobile tag by causing transmission of another activation signal from the location tracking apparatus to the access control apparatus.

11. The system of claim 8, wherein the wireless transceivers form a wireless communication network connecting the location tracking apparatus to the mobile tag, and wherein the at least one of the activation signals is transmitted through the wireless communication network.

12. The system of claim 8, the access control apparatus further comprising:

a transceiver;

at least one processor; and at least one memory including program instructions, wherein the at least one memory and the computer program code are configured, with the at least one processor, to cause the access control apparatus to:

cause the transceiver to use a first transmission power when establishing the communication connection with the mobile tag by;

carry out a verification procedure comprising communication with the mobile tag by causing the transceiver to use a second transmission power lower than the first transmission power, thus enabling verification whether or not the mobile tag is in close proximity of the access control apparatus; and grant access to the mobile tag, if the mobile tag is allowed to access the access-controlled entity and if the verification procedure results in successful communication between the access control apparatus and the mobile tag.

13. The system of claim 12, wherein the at least one memory and the computer program code are configured, with the at least one processor, to cause the access control apparatus to maintain or put on hold the communication connection with the mobile tag between the establishment of the communication connection and the verification procedure.

14. The system of claim 12, wherein the access control apparatus comprises a proximity sensor configured to detect close presence of mobile tags through magnetic or electromagnetic interaction, and wherein the at least one memory and the computer program code are configured, with the at least one processor, to cause the access control apparatus to trigger the verification procedure by the detection of the close proximity of the mobile tag by the proximity sensor.

15. A computer program product embodied on a non-transitory distribution medium readable by a computer and comprising program instructions which, when loaded into an apparatus, uses a location tracking comprising a radio network of location tracking nodes disposed in a predetermined coverage area, and an access control apparatus configured to communicate with the location tracking apparatus via the radio network of the location tracking nodes, to execute a computer process comprising:

tracking a location of at least one mobile tag in the predetermined coverage area of the location tracking system based on a location update message from the mobile tag or from at least one of the location tracking nodes, wherein the location tracking apparatus comprises a plurality of wireless transceivers operating as said location tracking nodes;

detecting presence of the mobile tag, by the location tracking apparatus on the basis of a current association between the mobile tag and at least one of the location tracking nodes in a determined area, of the predetermined coverage area, associated with said at least one of the location tracking nodes and at least one access-controlled entity, wherein each access-controlled entity is associated with the access control apparatus deactivated during the detection; and transmitting an activation signal from the location tracking apparatus to the access control apparatus in response to the detection of the mobile tag in the determined area in order to activate the access control apparatus to initiate establishment of a wireless communication connection between the mobile tag and the access control apparatus so as to negotiate about access to the access-controlled entity.

16. The system of claim 8, wherein the determined area comprises a plurality of access control entities.

* * * * *